United States Patent [19]

Strauss et al.

[11] Patent Number: 4,925,585

[45] Date of Patent: May 15, 1990

[54] DETERGENT GRANULES FROM COLD DOUGH USING FINE DISPERSION GRANULATION

[75] Inventors: Daniel L. Strauss, Mason; Thomas H. Taylor, Milford; Charles L. Stearns, Cincinnati; Thomas E. Lobaugh, Fremont, all of Ohio

[73] Assignee: The Procter & Gamble Company, Cincinnati, Ohio

[21] Appl. No.: 213,575

[22] Filed: Jun. 29, 1988 (Under 37 CFR 1.47)

[51] Int. Cl.[5] ..... C11D 11/00

[52] U.S. Cl. ..... 252/89.1; 252/134; 252/174; 252/539; 252/540; 252/558; 252/559; 264/117; 264/140

[58] Field of Search ..... 252/539, 540, 559, 558, 252/174, 134, 89.1; 264/140, 117

[56] References Cited

U.S. PATENT DOCUMENTS

| | | | |
|---|---|---|---|
| 2,480,730 | 8/1949 | Hafford | 252/539 |
| 2,874,123 | 2/1959 | Schaafsma et al. | 252/539 |
| 3,726,813 | 4/1973 | Borrello | 252/539 |
| 4,115,308 | 9/1978 | Guerry | 252/135 |
| 4,162,994 | 7/1979 | Kowalchuk | 252/532 |
| 4,427,417 | 1/1984 | Porasik | 23/313 R |
| 4,474,683 | 10/1984 | Story et al. | 252/369 |
| 4,487,710 | 12/1984 | Kaminski | 252/546 |
| 4,515,707 | 5/1985 | Brooks | 252/368 |
| 4,534,879 | 8/1985 | Iding et al. | 252/174 |

FOREIGN PATENT DOCUMENTS

| | | |
|---|---|---|
| 58-183540 | 9/1983 | Japan . |
| 61-118500 | 11/1984 | Japan . |
| 2171414 | 8/1986 | United Kingdom . |

*Primary Examiner*—Prince E. Willis

*Attorney, Agent, or Firm*—Leonard Williamson; Robert B. Aylor; Richard C. Witte

[57] ABSTRACT

The present invention relates to an energy saving process for preparing condensed detergent granules. Dry detergent builders and a high active surfactant paste are finely dispersed into a uniform dough. The dough is chilled and granulated using fine dispersion mixing to surprisingly provide discrete, uniform (300–1200 micron) free flowing, granular particles. The granules of the present invention are preferably formulated to be fully formulated.

10 Claims, No Drawings

DETERGENT GRANULES FROM COLD DOUGH USING FINE DISPERSION GRANULATION

FIELD OF INVENTION

The present invention relates to a process for preparing condensed detergent granules.

BACKGROUND OF THE INVENTION

Granular detergent compositions have so far been principally prepared by spray drying. In the spray drying process the detergent components, such as surfactants and builders, are mixed with as much as 35–50% heated and spray dried, which is expensive. A good agglomeration process, however, could be less expensive.

Spray drying requires 30–40 wt. % of the water to be removed. The equipment used to produce spray dry is expensive. The granule obtained has good solubility but a low bulk density, so the packing volume is large. Also, the flow properties of the granule obtained by spray drying are adversely affected by large surface irregularities, and thus the granulate has a poor appearance. There are other known disadvantages in preparing granular detergents by spray drying.

There are many prior art nonspray-drying processes which produce detergent granules. They have drawbacks as well. Most require more than one mixer and a separate granulation operation. Others require use of the acid form of the surfactant to work. Some others require high temperatures which degrade the starting materials. High active surfactant paste is avoided because of its stickiness.

High shear and cold mixing processes per se are known, but they require an extra grinding step or some other action. E.g., some use a dry neutralization technique of mixing an acid form of the surfactant with sodium carbonate. See, e.g., U.S. Pat. No. 4,515,707, Brooks, issued May 7, 1985; Japanese laid-open Appln. No. 183540/1983, Kao Soap Co., Ltd., filed Sept. 30, 1983; and Japanese Sho. 61-118500, Lion K.K., June 5, 1986. Typically, excess carbonate is required (2–10 molar excess) to assure reasonable conversion of the surfactant acids. Excess carbonate adversely drives up the wash water pH to the very alkaline range which can be undesirable, particularly for some nil-phosphate formulas.

Also, the use of a surfactant acid requires immediate use or cool temperature storage, for highly reactive acids such as the alkyl sulfate acids are subject to degradation unless cooled, they tend to undergo hydrolysis during storage, forming free sulfuric acid and alcohol. In practical terms, such prior art processes require close-coupling of surfactant acid production with granulation which requires an additional capital investment.

Another reason for not desiring to use the acid form of the surfactants in some applications is the potential degradation of other formula ingredients (e.g., tripolyphosphate converting to the less soluble pyrophosphate species).

In U.S. Pat. No. 4,162,994, Kowalchuk, issued July 31, 1979, it is disclosed that calcium salts are required to overcome problems in processing by nonspray drying (i.e., mechanical) means formulations based on sodium salts of anionic surfactants and certain nonionic surfactants. A drawback to that process is that insoluble calcium salts can lower the solubility of the formulation, which is of particular importance in stress situations, such as in pouch-type executions.

An important object of the present invention is to make a dense, concentrated detergent granular product by an agglomeration process as opposed to a spray-drying process. Other objects of the present invention will be apparent in view of the following.

SUMMARY OF THE INVENTION

The present invention relates to a more economical process for making a dense, concentrated detergent granular product from cold dough using fine dispersion granulation.

DETAILED DESCRIPTION OF THE INVENTION

The process comprises fine dispersion mixing of a high active surfactant paste and a dry detergency builder to form a uniform cookie-dough-like intermediate. The dough for many formulations, however, is too tacky at the dough-forming temperature to successfully granulate using fine dispersion mixing so the dough is cooled to a granulation temperature while mixing and large discrete particles (granules) are surprisingly formed right in the mixer. The "cold" granulation is achieved at −25° C. to 20° C. with a critical fine dispersion mixing tip speed of from about 5 m/sec. to about 50 m/sec. Dry ice is a preferred cooling means.

The granules made according to the present invention are large, low dust and free flowing, and preferably have a bulk density of from about 0.5 to about 1.1 g/cc, more preferably from about 0.7 to about 0.9 g/cc. The weight average particle size of the particles of this invention are from about 300 to about 1200 microns. The preferred granules so formed have a particle size range of from 500 to 900 microns. The more preferred granulation temperatures of the dough ranges from about −15° C. to about 15° C., and most preferably from about −10° C. to about 10° C.

Methods of Cooling the Dough

Any suitable method of cooling the dough to a granulation temperature can be used. Cooling jackets or coils can be integrated around or into the mixer. Chipped dry ice or liquid $CO_2$ can be added or injected into the uniform dough. The idea is to lower the dough temperature to a granulation temperature so that the dough can be finely dispersed or "granulated" into discrete particles.

Dough Moisture

It is important that the moisture content of the dough should not exceed 25%. The total moisture in the dough can range from about 1–25%, but is preferably about 2–20%, and most preferably about 4–10%. The lower dough granulation temperatures can be used for the lower builder and/or higher moisture formulas. Conversely, the higher granulation temperatures can be used for higher builder and/or lower moisture formulas.

Compositions which have lower moisture contents of below 5%, e.g., about 1% to 4%, can contain an effective amount of a liquid dough formation processing aid. Examples of such aids are selected from suitable organic liquid, including nonionics, mineral oil, glycerin, and the like. The dough formation processing aid preferably can be used at a level of "0.5% to 20%," more preferably about 1–15%; most preferably about 2–10% by weight of the dough.

Surprisingly, the dough and its resulting granules can comprise a combination of all, or substantially all, of the ingredients of the total composition and thus greatly reduce or even eliminate the need to admix additional materials. Also, the possibility of segregation of ingredients during shipping, handling or storage is greatly reduced.

It is preferable to use high active surfactant pastes to minimize the total water level in the system during mixing, granulating and drying. Lower water levels allow for: (1) a higher active surfactant to builder ratio, e.g., 1:1; (2) higher levels of other liquids in the formula without causing dough or granular stickiness; (3) less cooling, due to higher granulation temperatures; and (4) less granular drying to meet final moisture limits.

Two important parameters of the surfactant pastes which can affect the mixing and granulation step are the paste temperature and viscosity. Viscosity is a function of concentration and temperature, with a range in this application from about 10,000 cps to 10,000,000 cps. Preferably, the viscosity is from about 70,000 to about 7,000,000 cps. and more preferably from about 100,000 to about 1,000,000 cps. The viscosity of the paste of this invention is measured at a temperature of 50° C.

The paste can be introduced into the mixer at an initial temperature in the range of about 5°-70° C., preferably about 20°-30° C. Higher temperatures reduce viscosity but a temperature greater than about 70° C. can lead to poor mixing due to increased product stickiness.

Surprisingly, large, but usable, granules, can be formed in the process of the present invention. Preferably they are in the 300 to 1200 micron range. Such large granules improve process flowability and more importantly, the formation of dust is minimized. Low dust is important in consumer applications which comprise unitized dose pouch-like products which are designed: (1) to avoid consumer contact with the product and (2) to reinforce the convenience and nonmessiness perceptions of a unitized pouch form. If desired, granules of insufficient size can be screened after drying and recycled to the fine dispersion mixer.

Drying

The desired moisture content of the free flowing granules of this invention can be adjusted by adjusting the builder level of the paste/builder or the use of a processing aid in the dough formation prior to cooling and granulation. Thus, additional "drying" can be optional and unnecessary in low moisture formulations.

When desirable, drying the discrete granules formed from the cooled dough can be accomplished in a standard fluid bed dryer. The idea is to provide a free flowing granule with a desired moisture content of 1-8%, preferably 2-4%.

The Fine Dispersion Mixing and Granulation

The term "fine dispersion mixing and/or granulation," as used herein, means mixing and/or granulation of the above dough in a fine dispersion mixer at a blade tip speed of from about 5 m/sec. to about 50 m/sec., unless otherwise specified. The total residence time of the mixing and granulation process is preferably in the order of from 0.1 to 10 minutes, more preferably 0.5-8 and most preferably 1-6 minutes. The more preferred mixing and granulation tip speeds are about 10-40 m/sec. and about 15-35 m/sec. which is more critical for granulation and simply preferred for dough formation.

The Littleford Mixer, Model #FM-130-D-12, with internal chopping blades and the Cuisinart® Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

The mixer must finely disperse the paste and the other ingredients into a cookie-like dough stage. When the dough is cooled, the mixing must be conducted at said fine dispersion tip speed in order to granulate the dough into discrete particles. Care must be taken not to use too low or too high of a tip speed at the granulation step. While not being bound to a theory, "too high a shear" is believed to prevent granulation because of a wide variety of stresses and a broader particle size distribution caused by the higher tip speeds.

It is believed that the fine dispersion mixing and granulation at the cold dough granulation step provides: (1) a lower level of granulated fines; (2) a more uniform granular particle size distribution; (3) less degradation, e.g., sodium tripolyphosphate conversion to pyrophosphate; and (4) a higher density granule than a granular product made with standard agglomeration-type mixers, such as the pan-type mixers.

High Active Surfactant Paste

The activity of the aqueous surfactant paste is at least 40% and can go up to about 90%; preferred activities are: 50-80% and 65-75%. The balance of the paste is primarily water but can include a processing aid such as a nonionic surfactant. At the higher active concentrations, little or no builder is required for cold granulation of the paste. The resultant concentrated surfactant granules can be added to dry builders or used in conventional agglomeration operations.

The aqueous surfactant paste contains an organic surfactant selected from the group consisting of anionic, zwitterionic, ampholytic and cationic surfactants, and mixtures thereof. Anionic surfactants are preferred. Nonionic surfactants are used as secondary surfactants or processing aids and are not included herein as an "active" surfactant. Surfactants useful herein are listed in U.S. Pat. No. 3,664,961, Norris, issued May 23, 1972, and in U.S. Pat. No. 3,929,678, Laughlin et al., issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps," are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water soluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

The preferred anionic surfactant pastes are mixtures of linear or branched alkylbenzene sulfonates having an alkyl of 10–16 carbon atoms and alkyl sulfates having an alkyl of 10–18 carbon atoms. These pastes are usually produced by reacting a liquid organic material with sulfur trioxide to produce a sulfonic or sulfuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used. The neutralization can be performed as part of the fine dispersion mixing step, but preneutralization of the acid in conjunction with the acid production is preferred.

Water-soluble nonionic surfactants are also useful as secondary surfactant in the compositions of the invention. Indeed, preferred processes use anionic/nonionic blends. A particularly preferred paste comprises a blend of nonionic and anionic surfactants having a ratio of from about 0.01:1 to about 1:1, more preferably about 0.05:1. Nonionics can be used up to an equal amount of the primary organic surfactant. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 4 to 25 moles of ethylene oxide per mole of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary, ammonium phosphonium, and sulfonium compounds in which one of the aliphatic substituents contains from about 8 to 18 carbon atoms.

Particularly preferred surfactants herein include linear alkylbenzene sulfonates containing from about 11 to 14 carbon atoms in the alkyl group; tallow alkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_9$–$C_{15}$ alcohols with from about 3 to 8 moles of ethylene oxide, and mixtures thereof.

Specific preferred surfactants for use herein include: sodium linear $C_{11}$–$C_{13}$ alkylbenzene sulfonate; triethanolammonium $C_{11}$–$C_{13}$ alkylbenzene sulfonate; sodium tallow alkyl sulfate; sodium coconut alkyl glyceryl ether sulfonate; the sodium salt of a sulfated condensation product of a tallow alcohol with about 4 moles of ethylene oxide; the condensation product of a coconut fatty alcohol with about 6 moles of ethylene oxide; the condensation product of tallow fatty alcohol with about 11 moles of ethylene oxide; the condensation of a fatty alcohol containing from about 14 to about 15 carbon atoms with about 7 moles of ethylene oxide; the condensation product of a $C_{12}$–$C_{13}$ fatty alcohol with about 3 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio) hexanoate; dodecyldimethylamine oxide; coconutalkyldimethylamine oxide; and the water-soluble sodium and potassium salts of coconut and tallow fatty acids.

As used herein, the term "surfactant" means non-nonionic surfactants, unless otherwise specified. The ratio of the surfactant active (excluding the nonionic(s)) to dry detergent builder ranges from 0.05:1 to 1.5:1, and more preferably from 0.1:1 to 1.2:1. Even more preferred said surfactant active to builder ratios are 0.15:1 to 1:1; and 0.2:1 to 0.5:1.

Detergency Builders

Any compatible detergency builder or combination of builders can be used in the process and compositions of the present invention.

The detergent compositions herein can contain crystalline aluminosilicate ion exchange material of the formula $$Na_z(AlO_2)_z.(SiO_2)_y].xH_2O$$

wherein z and y are at least about 6, the molar ratio of z to y is from about 1.0 to about 0.4 and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_{3/g}$ (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chorides, fluorides and sulfates. The alkali metal, and especially sodium, salts of the above are preferred. Sodium sulfate is typically used in detergent granules and is a particularly preferred salt.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhydroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, incorporated herein by reference, and is preferably free of the latter.

One preferred composition contains at least 26% by weight of the ether polycarboxylate builder (EPB). Another contains from about 5% to about 35% organic salt of citrate. Yet another contains from about 3% to about 25% ether polycarboxylate and from about 1% to about 15% organic salt of citrate, more preferably from about 5% to about 15% ether polycarboxylate with citrate with a ratio of 2:1 to 1:2.

The EPB's provide synergistic cleaning performance when combined with the aluminosilicate detergency builder, especially hydrated Zeolite A with a particle size of less than about 5 microns. The benefit is greatest for lower levels of EPB's up to a 1:1 ratio of EPB to aluminosilicate.

Specific preferred examples of ether polycarboxylate detergency builders, processes for making them, etc. are disclosed in commonly assigned U.S. patent application Ser. No. 823,909, filed Jan. 30, 1986, by Rodney D. Bush, Daniel S. Connor, Stephen W. Heinzman, and Larry N. Mackey, entitled "Ether Carboxylate Detergency Builders and Process for Their Preparation," now U.S. Pat. No. 4,663,071, issued May 5, 1987, said patent being incorporated herein by reference. Other ether polycarboxylate detergency builders useful herein are disclosed in U.S. Pat. No. 3,635,830, Lamberti et al., issued Jan. 18, 1972; U.S. Pat. No. 3,784,486, Nelson et al., issued Jan. 8, 1974; U.S. Pat. No. 4,021,376, Lamberti et al., issued May 3, 1977; U.S. Pat. No. 3,965,169, Stahlheber, issued June 22, 1976; U.S. Pat. No. 3,970,698, Lannert, issued July 20, 1976; U.S. Pat. No. 4,566,984, Bush, issued Jan. 28, 1986; and U.S. Pat. No. 4,066,687, Nelson et al., issued Jan. 3, 1978; all of said patents being incorporated herein by reference.

Optionals

Other ingredients commonly used in detergent compositions can be included in the compositions of the present invention. These include flow aids, color specks, bleaching agents and bleach activators, suds boosters or suds suppressors, antitarnish and anticorrosion agents, soil suspending agents, soil release agents, dyes, fillers, optical brighteners, germicides, pH adjusting agents, nonbuilder alkalinity sources, hydrotropes, enzymes, enzyme-stabilizing agents, chelating agents and perfumes.

The detergent granules of the present invention are particularly useful in a pouched through-the-wash product. Materials like sodium perborate tetrahydrate and monohydrate can be included as part of the granular detergent compositions of this invention. Pouched through-the-wash products are disclosed in the art, e.g., those disclosed in commonly assigned U.S. Pat. No. 4,740,326, Hortel et al., issued Apr. 26, 1988. incorporated herein by reference. Another useful pouch has at least one of its walls constructed of a finely apertured polymeric film.

The terms "LAS" and "AS" as used herein mean, respectively, "sodium lauryl benzene sulfonate" and "alkyl sulfate." The terms like "$C_{45}$" mean $C_{14}$ and $C_{15}$ alkyl, unless otherwise specified.

The invention will be better understood in view of the following nonlimiting examples. The percentages are on a before drying weight basis, unless otherwise specified. The tables are followed with additional processing disclosure.

TABLE (Part 1)
EXAMPLES 1-4

| Dough Ingredients | Ex. 1 | Ex. 2 | Ex. 3 | Ex. 4 |
|---|---|---|---|---|
| $C_{13}$ LAS[a,b] (100% active basis) | 10.46 | 8.34 | 11.43 | 14.78 |
| $C_{45}$ AS[a,b] (100% active basis) | 10.46 | 8.34 | 4.89 | 14.78 |
| $Na_2SO_4$ | 7.28 | 8.71 | 8.51 | 9.17 |
| Sodium silicate 2.0r[b] | 7.47 | 5.56 | 5.44 | — |
| Polyethylene glycol (Avg. M.W. approx. 8000) | — | 0.56 | 1.63 | 0.47 |
| Sodium polyacrylate (Avg. M.W. approx. 4500 | 0.43 | 0.78 | 0.82 | 0.62 |
| Neodol 23-6.5[a,h] | 1.49 | 1.11 | 2.19[c] | — |
| Sodium tripolyphosphate[b] | — | 50.05 | 48.96 | — |
| $Na_2CO_3$[b] | 6.57 | 6.67 | 6.53 | 4.15 |
| Optical brightener | 1.16 | 1.00 | 0.98 | 0.73 |
| Silicone/PEG coflake (5/95) | 1.99 | 1.57 | 1.54 | 1.26 |
| Sodium citrate.$2H_2O$[b] | 17.16 | — | — | 18.90 |
| Sodium aluminosilicate. $27H_2O$[b] | 26.08 | — | — | 20.63 |
| DTPA[i] | — | — | — | 0.47 |
| Unreacted | 0.60 | 0.48 | 0.48 | 0.84 |
| Water (Free) | 8.91 | 6.83 | 6.61 | 13.20 |
| Granule Properties | | | | |
| $H_2O$ after drying | 2.50 | 2.50 | 2.50 | 1.80 |
| Bulk density (g/cc) | 0.86 | 0.74 | .0.84 | 0.82 |
| Flow properties at granulation | Good | Good | Good | Good |
| Process Conditions: | | | | |
| Mixer type[d] | L | L | L | C |
| Mix time (min.) | 3.25 | 5.25 | 3.45 | 1.25 |
| Mix temperature-before granulation (°C.) | 28 | 26 | 28 | 27 |
| Mix temperature-after granulation (°C.) | 10 | 7 | 1 | −3 |
| Fluid bed air temp. (°C.) | 70 | 70 | 70 | 80 |
| Paste activity (%) | 70 | 73 | 73 | 70 |
| Paste/Builder Ratio[b] | 0.36 | 0.27 | 0.27 | 0.68 |
| Nonionic/Anionic Ratio[a] | 0.07 | 0.07 | 0.13 | 0 |
| Paste viscosity[f]AS | 7 MM | 7 MM | 7 MM | 7 MM |
| Paste viscosity[f]LAS | 800 M | 800 M | 800 M | 800 M |

(Part 2)
EXAMPLES 5-8

TABLE-continued

| Dough Ingredients | Comparative Ex. 5 | Ex. 6 | Ex. 7 | Ex. 8 |
|---|---|---|---|---|
| $C_{13}$ LAS[a,b] (100% active basis) | 3.66 | 3.66 | 11.12 | 9.76 |
| $C_{45}$ AS[a,b] (100% active basis) | 3.66 | 3.66 | 11.12 | 9.76 |
| $Na_2SO_4$ | 13.05 | 13.05 | 10.84 | 9.52 |
| Sodium silicate 2.0r[b] | — | — | — | — |
| Polyethylene glycol (Avg. M.W. approx. 8000) | 0.67 | 0.67 | — | 9.49 |
| Sodium polyacrylate (Avg. M.W. approx. 4500 | 0.89 | 0.89 | 0.74 | 0.65 |
| Neodol 23-6.5[a,h] | 7.31 | 7.31 | — | — |
| Sodium tripolyphosphate[b] | — | — | — | — |
| $Na_2CO_3$[b] | 5.90 | 5.90 | 4.90 | 4.30 |
| Optical brightener | 1.04 | 1.04 | 0.87 | 0.76 |
| Silicone/PEG coflake (5/95) | 1.79 | 1.79 | 1.48 | 1.30 |
| Sodium citrate.$2H_2O$[b] | 26.84 | 26.84 | 22.28 | 19.58 |
| Sodium aluminosilicate. $27H_2O$[b] | 29.29 | 29.29 | 24.32 | 21.37 |
| DTPA[i] | 0.67 | 0.67 | 0.55 | 0.49 |
| Unreacted | 0.21 | 0.21 | 0.63 | 0.56 |
| Water | 5.02 | 5.02 | 10.60 | 21.46 |
| Granule Properties | | | | |
| $H_2O$ after drying | — | 2.40 | 1.90 | 2.50 |
| Bulk density (g/cc) | — | 0.78 | 0.75 | 0.73 |
| Flow properties at granulation | (e) | Good | Good | Good |
| Process Conditions | Ex. 5 | Ex. 6 | Ex. 7 | Ex. 8 |
| Mixer type[d] | C | C | C | C |
| Mix time (min.) | 4.00 | 4.25 | 2.25 | 2.75 |
| Mix temperature-before granulation (°C.) | 24[e] | 24 | 22 | 26 |
| Mix temperature-after granulation (°C.) | 24[e] | −23 | 9 | −10 |
| Fluid bed air temp. (°C.) | — | 80 | 80 | 80 |
| Paste activity (%) | 70 | 70 | 70 | 49/70(g) |
| Paste/Builder Ratio[b] | 0.12 | 0.12 | 0.43 | 0.43 |
| Nonionic/Anionic Ratio[a] | 1.00 | 1.00 | 0 | 0 |
| Paste viscosity[f]AS | 7 MM | 7 MM | 7 MM | 7 MM |
| Paste viscosity[f]LAS | 800 M | 800 M | 800 M | 20 M |

Table Footnotes
[a]used in calculating nonionic/anionic ratio.
[b]used in calculating paste/builder ratio.
[c]Tergitol 80 L-50 N replaces Neodol and is an ethoxylated propoxylated 5.3 EO and 0.9 PO, approximately with alkyl chain lengths of $C_8$ (20%) to $C_{10}$ (80%).
[d]L = Batch Littleford, Model #FM-130-D-12, with high speed internal chopping blades having 4, 6 and 8 inch diameters operated at 3500 rpm for respective tip speed of 18.6, 27.9, and 37.3 m/sec.
C = Cuisinart Food Processor, Model #DCX-Plus with 19.7 cms (7.75 inch) blades at 1800 rpm. Tip speed 18.55 m/sec.
[e]Did not form granules.
[f]Viscosity measured using Brookfield HAT Serial #74002.
For LAS, at 0.5 rpm with spindle T-A at 50° C.
For AS, at 0.5 rpm with spindle T-E at 50° C.
[g]LAS active = 49%; AS active = 70%.
[h]Neodol 23-6.5 is a primary alcohol ethoxylate ($C_{12}$–$C_{13}$) with nominal 6.5 moles of ethylene oxide.
[i]Sodium diethylene triamine penta acetate.

EXAMPLE 1

Referring to Example 1 in the Table, the aqueous paste having a detergent activity of 70%, the balance being water, is mixed with dry detergent builders and other formula minors in a Littleford mixer, Model #FM-130-D-12, fitted with high speed internal chopping blades to form a detergent dough. Dry ingredients are added first and mixed for less than a minute. Then, the paste and liquids are added. The viscosity is about 7MM cp. for the $C_{45}$ AS paste and about 800M cp. for the $C_{13}$ LAS. The paste temperature is about 25° C. The main mixer shaft is operated at 60 rpm and three sets of chopping blades (d) at 3500 rpm. The moisture content of the dough is 8.9%, the paste/builder ratio is 0.36, the temperature of the dough is 28° C. prior to granulation and the nonionic/anionic ratio is 0.07. Dry ice is added as needed to the mixer to drop the dough temperature from about 28° C. to about 10° C. to form discrete particles of detergent (granules). The granules are dried in a batch fluid bed dryer using 70° C. air to reduce the moisture content from 8.9% to 2.5%. The finished granules are low dust and free flowing with a bulk density of 0.86 g/cc. The process and detergent granule of this Example are particularly preferred modes of the present invention.

EXAMPLE 2

Referring to the Table, Example 2 is similar to Example 1. Key differences include the replacement of the nonphosphate builders (citrate and aluminosilicate) with sodium tripolyphosphate (STPP), a lower paste/-builder ratio of 0.27 vs. 0.36 and a lower dough moisture of 6.8%. Other differences include slightly lower mix and granulation temperatures, a slightly higher paste activity of 73%, a longer mix time, and a finished granule bulk density of 0.74 g/cc.

EXAMPLE 3

Referring to the Table, Example 3 is similar to Example 2, except a different ratio of AS/LAS is used (30/70 vs. 50/50) and Tergitol replaces Neodol as the nonionic. The finished granules have a bulk density of 0.84 g/cc.

EXAMPLE 4

Example 4 uses a Cuisinart food processor, Model #DCX-Plus with 7.75 inch metal blades operating at 1800 rpm, as the fine dispersion mixer. The paste viscosity is about 7MM for the $C_{45}$ AS and about 800M for the $C_{13}$ LAS, with the temperature about 27° C. The moisture content of the dough is 13.2%, the paste/builder ratio is 0.68 and the nonionic/anionic ratio is 0. Dry ice is added to drop the dough temperature from 27° C. to −3° C. to form detergent granules. The granules are dried in a fluid bed dryer to a final moisture content of 1.8% and a density of 0.82 g/cc.

COMPARATIVE EXAMPLE 5

Example 5 illustrates the critical importance of cooling the dough for such a formulation in order to form discrete granules. The properties of the paste are similar to Example 4. The moisture content of the dough is 5.02%, the paste/builder ratio is 0.12 and the nonionic-/anionic ratio is 1.00. But the dough temperature is 24° C. Dry ice is not added to this dough and granules are not formed. See Example 6 for a fix to the problem.

EXAMPLE 6

Example 6 is a continuation of Example 5. Dry ice is added to the mixer to lower the temperature to −23° C. Discrete detergent granules are formed. After drying, the granules have a moisture content of 2.4% and a bulk density of 0.78 g/cc.

EXAMPLE 7

Example 7 is similar to Example 1, except the Cuisinart food processor is used as the fine dispersion mixer in place of the Littleford mixer.

EXAMPLE 8

Example 8 uses a lower active $C_{13}$ LAS (49% active with a viscosity of about 20M cp.) than the other examples cited. The moisture content of the dough is 21.5%. Dry ice was added to lower the temperature from 26°

C. to −10° C. to form detergent granules. The flow properties of the nondried granules are only fair due to the high moisture content. After drying, the granules were free flowing with a moisture content of 2.5% and a bulk density of 0.73 g/cc.

The present invention is illustrated in the above nonlimiting Examples. Comparative Example 5 fails to granulate because the dough temperature is too high for granulation. Similarly, if the mixing tip speeds are too high, the dough will not granulate. Thus, the present invention is a quick and efficient granulation process having the following six advantages: (1) avoidance of spray tower and resultant environmental discharge negatives; (2) elimination of dependency on acid forms of surfactants as starting material, thus saving costs in shipping; (3) less water is needed, so less energy is required to dry starting materials; (4) avoidance of the tacky granule problem by cooling; (5) the product is an attractive, high bulk density, free flowing granule; and (6) formulation flexibility for good product solubility.

What is claimed is:

1. A process for making a free flowing granular detergent comprising:

A. mixing an effective amount of an aqueous surfactant paste having a detergency activity of at least 40% and an effective amount of a dry detergency builder, said surfactant paste active and builder having a ratio of 0.05:1 to 1.5:1;

B. rapidly forming a uniform dough from said mix at a dough temperature of from about 15° C. to about 35° C;

C. cooling said dough to a granulation temperature of from about −25° C. to about 20° C.;

D. granulating said cooled dough into discrete detergent granules using fine dispersion mixing at a tip speed of about 5–50 m/sec; and wherein said surfactant is selected from the group consisting of anionic, zwitterionic, ampholytic and cationic surfactants and mixtures thereof; and wherein said mixing and granulating are conducted with a mixer residence time of from about 0.1 to about 10 minutes.

2. A process according to claim 1 wherein said granulation temperature of said dough is about −15° C. to about 15° C.

3. A process according to claim 1 wherein said tip speed is 10–40 m/sec and said residence time is 0.5–8 minutes.

4. A process according to claim 1 wherein said surfactant paste and said dry detergency builder have a weight ratio range of from about 0.1:1 to about 1.2:1; and wherein said paste has a detergency activity up to 90%; and wherein said paste has a viscosity of from 10,000 to about 10,000,000 cps.

5. A process according to claim 1 wherein said paste and said dry detergency builders have a ratio of from 0.15:1 to 1:1; and wherein said paste has a detergency activity of 50–80%; and wherein said paste has a viscosity of from about 70,000 to about 7,000,000 cps; said paste is used at an initial temperature of 20°–30° C., and wherein said granulation temperature is about −15° C. to about 15° C. and wherein said discrete detergent granules formed from said dough have an average particle size of from about 300 microns to about 1200 microns and wherein said dried granules have a bulk density of from about 0.5 to about 1.1 g/cc.

6. The process according to claim 1 wherein the ratio of said paste and said dry detergency builder is from about 0.2:1 to 0.5:1 and wherein said detergency activity of said paste is about 65–75%; and wherein the density of said granules is from about 0.7 to about 0.9 g/cc.

7. A process according to claim 1 wherein said paste comprises nonionic and anionic surfactants having a ratio of from about 0.01:1 to about 1:1.

8. A process according to claim 1 wherein the moisture in said discrete granules is reduced by drying in a fluid bed dryer to a moisture content of 1–8%.

9. A process according to claim 8 wherein said moisture content of said discrete particles is 2–4%.

10. A product made by the process of claim 1.

* * * * *